United States Patent [19]

Bushnell

[11] 3,972,802

[45] Aug. 3, 1976

[54] IMMISCIBLE COOLANT IN PROPYLENE-ACETONE DEWAXING

[75] Inventor: James D. Bushnell, Berkeley Heights, N.J.

[73] Assignee: Exxon Research & Engineering Co., Linden, N.J.

[22] Filed: June 5, 1975

[21] Appl. No.: 584,034

[52] U.S. Cl. ..... 208/33; 208/37

[51] Int. Cl.[2] ..... C10G 43/08

[58] Field of Search ..... 208/33

[56] References Cited

UNITED STATES PATENTS 3,681,230 8/1972 Eagen et al. ..... 208/33

*Primary Examiner*—Herbert Levine

*Attorney, Agent, or Firm*—Marthe L. Gibbons

[57] ABSTRACT

A dewaxing process is provided in which a mixture of a solvent comprising propylene-acetone and a waxy petroleum oil is contacted with a cold aqueous solution of acetone and methanol. The aqueous acetone-methanol solution, which is immiscible in the waxy oil-solvent mixture, cools the mixture thereby crystallizing a substantial portion of the wax in the mixture.

10 Claims, 2 Drawing Figures

FIGURE I

IMMISCIBLE COOLANT IN PROPYLENE-ACETONE DEWAXING

BACKGROUND OF THE INVENTION

1. Field of the Invention

This invention relates to a process for separating a mixture of wax and mineral oil. More particularly, it relates to an improved solvent dewaxing process.

2. Description of the Prior Art

It is well known in the art to remove waxy constituents from wax-containing hydrocarbons, particularly from wax-containing petroleum oils by various methods. These processes generally chill the wax-containing oil in the presence of a solvent to a temperature at which the waxy constituents are crystallized (precipitated) out of solution. The chilled mixture containing the crystallized wax is then further treated to separate the crystallized wax particles from the dewaxed oil by various means usually by filtration, although sedimentation or centrifugation may be used.

It is known to dewax oil by DILCHILL (service mark of Exxon Research and Engineering Company for a dewaxing process) such as the process described in U.S. Pat. 3,773,650 issued Nov. 20, 1973; U.S. Pat. No. 3,644,195 issued Feb. 22, 1972 and U.S. Pat. No. 3,642,609 issued Feb. 15, 1972, the teachings of which are hereby incorporated by reference. The DILCHILL process comprises introducing a wax-oil mixture containing a substantial portion of wax dissolved therein into a cooling zone divided into a plurality of stages and passing the wax-oil mixture from stage to stage of the cooling zone while introducing cold dewaxing solvent incrementally along the length of the cooling zone thereby cooling the wax-oil mixture and precipitating a substantial portion of the wax therefrom. High levels of agitation are provided in at least a portion of the solvent-wax oil mixture-containing stages thereby providing substantially instantaneous mixing of the oil and solvent. Since utilization of the DILCHILL technique to cool the mixture completely to a subsequent wax separation temperature (e.g., filtration temperature) requires a high solvent dilution ratio or very low solvent temperatures which are obtainable, for example, by using a cascade refrigeration system, it has been found preferable to utilize the DILCHILL process to reduce the temperature of the waxy oil only partially to a temperature above the wax separation temperature followed by cooling in an additional chilling stage, such as, for example, the combination DILCHILL with scraped surface chilling process described in U.S. Pat. No. 3,775,288 issued Nov. 27, 1973, the teachings of which are hereby incorporated by reference.

It has now been found that the waxy oil mixture can be chilled to the wax separation temperature or to a temperature less than about 25°F. above the wax separation temperature without the above stated disadvantages.

SUMMARY OF THE INVENTION

In accordance with the invention there is provided, in a dewaxing process wherein a waxy petroleum oil is contacted with a solvent comprising propylene and acetone to form a solvent-waxy oil mixture, the improvement which comprises, in combination, contacting said solvent-waxy oil mixture with a cold solution of aqueous acetone-methanol to reduce the temperature of said mixture and to precipitate a substantial portion of the wax therefrom, and separating the precipitated wax from said mixture at wax separation temperature.

In one embodiment of the invention, the contacting step with the aqueous acetone-methanol solution is conducted in a countercurrent contacting zone.

In another embodiment of the invention, the contacting step with the aqueous acetone-methanol solution is conducted in a multistage contacting zone (DILCHILL zone) in which a high degree of agitation is maintained in at least a portion of the stages and into which the dilution solvent and the aqueous acetone-methanol are each, respectively, introduced incrementally along the height of the zone.

Use of the cold methanol-acetone solution, which is immiscible in the propylene-acetone/waxy oil mixture, permits continuous cooling to a temperature ranging from about 0° to about 25°F. above the wax separation temperature, preferably to about 5°F. above the wax separation temperature, thereby eliminating the need for batch cooling after the DILCHILL stage.

As used herein, the term "separation temperature" refers to the temperature at which the precipitated (crystallized) wax is separated from the wax-oil mixture.

Any petroleum oil feedstock can be dewaxed by the process of the invention. Generally, these oil stocks, which may be distillate fractions or residual oil fractions, have atmospheric pressure boiling points ranging between about 500° and 1,300°F. Preferred oil feedstocks are the lubricating oils and specialty oil fractions boiling within the range of about 550° to about 1,200°F. (at atmospheric pressure) and having viscosities ranging from about 50 to about 4,000 SSU/100°F.

The propylene-acetone solvent generally comprises from about 5 to about 30 liquid volume percent (LV%) acetone. Suitable ratios of solvent to waxy oil in the solvent-waxy oil mixture include volumetric ratios varying from about 0.9:1 to 4:1.

The aqueous solvent solution of acetone and methanol generally comprises from about 5 to about 30 LV% acetone; from about 25 to about 45 LV% methanol, the remaining balance being water plus a small amount of dissolved propylene. The aqueous phase is in liquid-liquid equilibrium with the oilpropylene-acetone-methanol phase. The compositions are adjusted so that the aqueous phase has sufficient methanol to be above its freezing point at the lowest temperature used in the process, sufficient acetone to insure enough acetone in the hydrocarbon phase to act as an anti-solvent for wax and sufficient water to insure phase separation with the heavier phase dense enough to settle rapidly from the hydrocarbon phase. Typical compositions (on a propylenefree basis) would be, for example, 30 LV% acetone, 30 LV% methanol, and 40 LV% water or 5 LV% acetone, 45 LV% methanol, and 50 LV% water.

Suitable ratios of aqueous coolant solution of acetone and methanol to waxy oil utilized in the contacting step include volumetric ratios varying from about 1:1 to 4:1.

DESCRIPTION OF THE PREFERRED EMBODIMENTS

The preferred embodiments will be described with reference to the accompanying figures.

Figure 1:
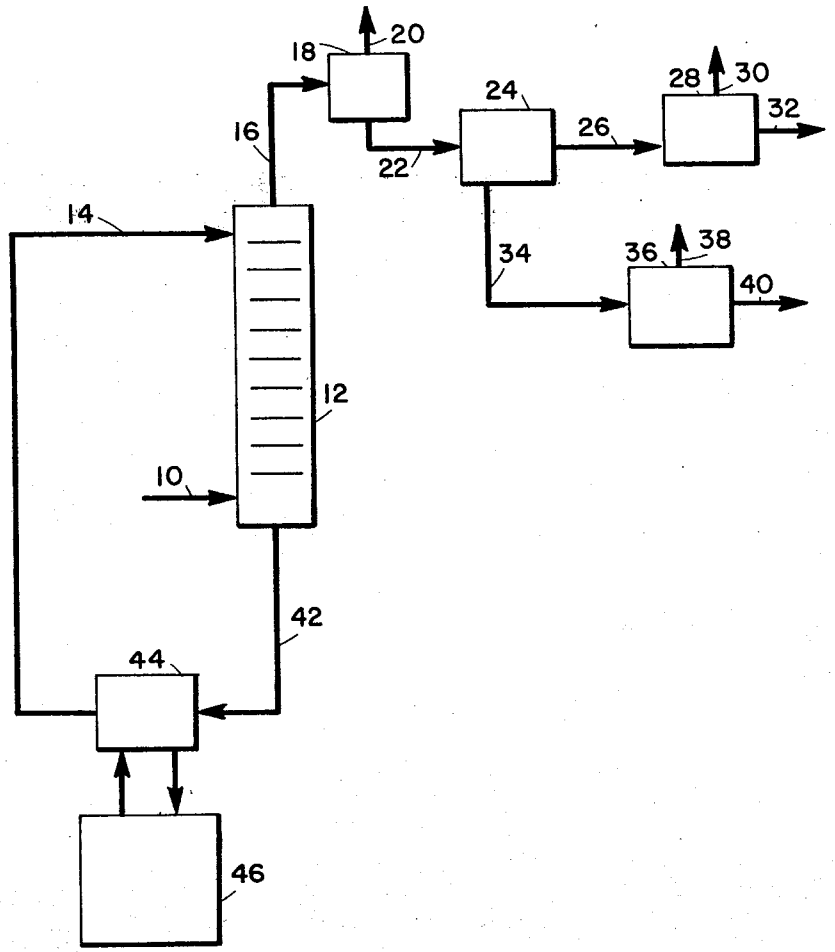
FIG. 1 is a diagrammatic flow plan of one embodiment of the invention.

Referring to FIG. 1, a mixture of propylene-acetone solvent and a waxy oil feed is introduced via line 10 into the bottom of a countercurrent chilling tower 12. The mixture of propylene-acetone solvent and waxy oil feed carried in line 10 may be made by mixing a waxy oil feed with warm (e.g. 100° to 150°F.) propylene-acetone solvent and then cooling the mixture in a shell and tube exchanger to as low a temperature as practical (e.g. 60°–100°F.) without plugging the exchanger with wax. The resulting mixture is then charged to the bottom of tower 12 via line 10. Alternatively, the mixture of propylene-acetone solvent and waxy feed carried in line 10 may be made by mixing a warm waxy feed with cold dilution propylene-acetone in a multistage dilution chilling tower to form the initial wax crystals and to cool the waxy feed to a temperature ranging from about 35° to 50°F. The resulting mixture (slurry) is then charged to the bottom of tower 12. A cold solution of aqueous acetone-methanol is introduced into the top of tower 12 via line 14. The mixture of propylene acetone-waxy oil rises through tower 12, being chilled as it rises by contact with colder aqueous phase of methanol-acetone on each stage, thus crystallizing out the wax. The slurry leaving the top of tower 12 via line 16 has a temperature almost as low as the desired wax separation temperature (e.g. filtration). The slurry carried in line 16 is subsequently introduced into a surge drum 18 where a small portion of the propylene solvent is flashed off via line 20 to cool the slurry to the filtration temperature by auto-refrigeration. The slurry which has been chilled to the final desired filtration temperature (e.g. minus 35°F.) is removed from surge drum 18 via line 22 and introduced into continuous rotary filters indicated at 24 to separate the precipitated wax from the oil. The filtrate is removed via line 26 and passed to a distillation stage 28 to separate the solvent from the dewaxed oil. The solvent is recovered via line 30 and dewaxed oil is recovered via line 32. The wax slurry removed from filtration stage 24 via line 34 is passed to a distillation stage 36 to separate solvent from the wax. The solvent is removed via line 38 and wax is removed via line 40. Returning to countercurrent tower 12, warm aqueous methanol-acetone solution leaving the bottom of tower 12 via line 42 is cooled down to a temperature of about minus 35°F. in chilling stage 44 by heat exchange and chilling with propylene refrigerant either by direct contact or in indirect heat exchange and recycled to the top of tower 12 via line 14. The propylene refrigeration system is indicated at 46.

Figure 2:
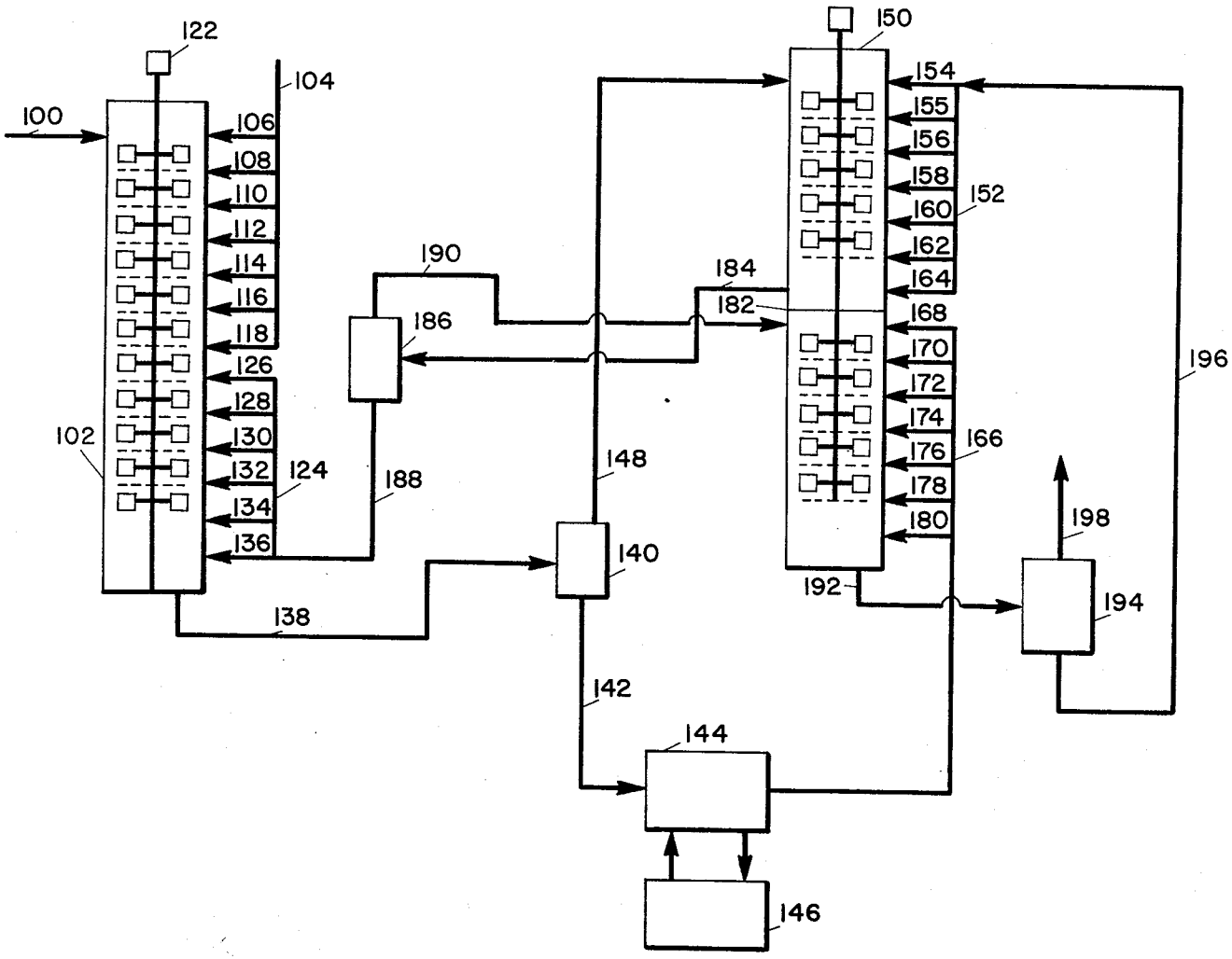
FIG. 2 is a diagrammatic flow plan of another embodiment of the invention.

In the embodiment shown in FIG. 2, a warm waxy oil feed is introduced via line 100 into the top of DILCHILL crystallizer 102. The expression "DILCHILL crystallizer" is used herein to designate a multistage crystallizer in which the solvent is added at a plurality of points along the vertical crystallizer while maintaining a zone of intense agitation by mechanical means at least at a portion of the points of solvent injection such that substantially instantaneous mixing occurs at these points. Cold propylene-acetone dilution solvent is carried in manifold 104. The manifold comprises a series of parallel lines 106, 108, 110, 112, 114, 116, 118, through which the solvent is added incrementally to the upper stages of DILCHILL crystallizer 102 to cool the oil slurry partially towards the wax separation (filtration) temperature. The first portion of the solvent enters the first stage of DILCHILL crystallizer 102 via line 106 where it is substantially instantaneously mixed with the oil by the action of agitator 120. The agitator is driven by a variable speed motor 122 and the degree of agitation is controlled by variation of the motor's speed, with due allowance for flow rate through tower 102. At various heights along the DILCHILL crystallizer, additional solvent is introduced to several stages through lines 108, 110, 112, 114, 116, and 118 so as to maintain substantially the same temperature drop from one mixing stage to the next and at the same time provide the desired degree of dilution.

In the lower stages of DILCHILL crystallizer 102, a cold solution of aqueous acetone-methanol is added via manifold 124 and inlet lines 126, 128, 130, 132, 134 and 136. The effluent from DILCHILL crystallizer 102 is sent via line 138 to a first settler 140 where the lower aqueous methanol-acetone phase is drawn off and sent via line 142 to a chiller 144 and cooled by a propylene refrigeration system indicated at 146 to a temperature of about minus 35°F. The hydrocarbon slurry is removed from settler 140 via line 148 and introduced to the upper portion of a second DILCHILL tower 150 where it is contacted in each stage with a colder aqueous acetone-methanol solution introduced into tower 150 via manifold 152 and inlet lines 154, 155, 156, 158, 160, 162 and 164. A partition 182 is located about half way down tower 150 to permit the hydrocarbon phase and the aqueous phase to be drawn off from the tower via line 184 and sent to a second liquid-liquid settler 186. The cool aqueous acetone-methanol phase is drawn off from the bottom of settler 186 and sent via line 188 into manifold 124 for introduction into the lower stage of DILCHILL crystallizer 102 as previously described.

The hydrocarbon phase is removed from settler 186 via line 190 and introduced into a middle portion of tower 150 below partition 182. This hydrocarbon phase proceeds down through the lower stages of tower 150 where it is further cooled almost to the filtration temperature by contact with the coldest aqueous acetone-methanol phase injected via manifold 166 and inlet lines 168, 170, 172, 174, 176, 178 and 180 into each of the lower stages. The effluent of tower 150 is removed via line 192 and introduced into a third settler 194 from which the aqueous acetone-methanol phase is removed via line 196 and sent into manifold line 152 to be used as coolant in the upper stages of tower 150. The slurry from settler 194 is removed via line 198 and subsequently flashed a few degrees down to filtration temperature, filtered and the solvent recovered from the dewaxed oil and waxy products by distillation as already described with reference to the embodiment of FIG. 1. It should be noted that the first, second and third settlers in the embodiment of FIG. 2 operate at progressively lower temperatures. The flow of the aqueous phase is staged to act in a somewhat countercurrent manner between the various sections of the DILCHILL towers. This arrangement reduces the quantity of aqueous acetone-methanol phase which must be circulated to cool the slurry down to about filtration temperature and makes this scheme practical and efficient.

What is claimed is:

1. In a dewaxing process wherein a waxy petroleum oil is contacted with a solvent comprising propylene and acetone to form a solvent-waxy oil mixture, the improvement which comprises, in combination, contacting said solvent-waxy oil mixture with a cold solution of aqueous acetone-methanol to reduce the temperature of said mixture and thereby precipitate a substantial portion of the wax therefrom, and separating the precipitated wax from said mixture at wax separation temperature.

2. The process of claim 1, wherein said solvent-waxy oil mixture is contacted with said cold aqueous solution of acetone-methanol to reduce the temperature of said mixture to a range varying from about 0° to about 25°F. above said wax separation temperature.

3. The process of claim 1, wherein said solvent-waxy oil mixture is contacted with said cold aqueous solution of acetone-methanol to reduce the temperature of said mixture to about 5°F. above said wax separation temperature.

4. The process of claim 1, wherein said solvent-waxy oil mixture is contacted with said cold aqueous solution of acetone-methanol to reduce the temperature of said mixture to a temperature above said wax separation temperature, subsequently separating said aqueous acetone-methanol from said mixture, flashing a portion of said solvent from said mixture to further reduce the temperature of said mixture to said separation temperature, separating precipitated wax from said mixture and recovering said solvent.

5. The process of claim 1, wherein said propylene-acetone solvent comprises from about 5 to about 30 liquid volume percent acetone.

6. The process of claim 1, wherein said aqueous solution of acetone and methanol comprises from about 5 to about 30 LV% acetone and from about 25 to about 45 LV% methanol.

7. The process of claim 1, wherein said solvent-waxy oil mixture is contacted with said aqueous acetone-methanol in a chilling zone comprising a countercurrent treating zone divided into a plurality of stages.

8. The process of claim 1, wherein said solvent-waxy oil mixture is contacted with said aqueous acetone-methanol in a chilling zone divided into a plurality of stages and wherein said aqueous acetone-methanol is introduced into at least a portion of said stages while maintaining a high degree of agitation so as to effect a substantially instantaneous mixing of said mixture and said aqueous acetone-methanol and cooling said mixture as it progresses through said chilling zone.

9. The process of claim 1, wherein said solvent is present in said solvent-waxy oil mixture in a solvent to oil volumetric ratio ranging from about 0.9:1 to 4:1.

10. The process of claim 1, wherein said aqueous solution of acetone-methanol utilized in said contacting step ranges in a volumetric ratio of said aqueous solution to said oil from about 1:1 to 4:1.

* * * * *